US007810638B2

(12) United States Patent
Milesi

(10) Patent No.: US 7,810,638 B2
(45) Date of Patent: Oct. 12, 2010

(54) PACKAGING FOR COSMETIC PRODUCTS, TYPICALLY A COMPACT, WITH AN IMPROVED GRIP AND THAT CAN BE OPENED WITH A SINGLE HAND

(75) Inventor: Frederic Milesi, Paris (FR)

(73) Assignee: Techpack International, Chevilly Larue (FR)

( * ) Notice: Subject to any disclaimer, the term of this patent is extended or adjusted under 35 U.S.C. 154(b) by 433 days.

(21) Appl. No.: 11/286,333

(22) Filed: Nov. 25, 2005

(65) Prior Publication Data

US 2006/0118455 A1 Jun. 8, 2006

(30) Foreign Application Priority Data

Dec. 7, 2004 (FR) ..... 04 12998

(51) Int. Cl.

| | |
|---|---|
| ***B65D 69/00*** | (2006.01) |
| ***A45D 42/02*** | (2006.01) |
| ***A45D 33/00*** | (2006.01) |
| ***A45D 42/00*** | (2006.01) |
| ***A45D 40/24*** | (2006.01) |

(52) U.S. Cl. ..... 206/235; 206/681; 206/823; 132/293; 132/301; 132/316; 132/317

(58) Field of Classification Search ..... 206/235, 206/581, 823; 132/301, 305, 312, 315–317
See application file for complete search history.

(56) References Cited

U.S. PATENT DOCUMENTS

| | | | | |
|---|---|---|---|---|
| 3,256,882 A | | 6/1966 | Esposito | |
| 3,256,892 A | | 6/1966 | Esposito | |
| 4,681,127 A | | 7/1987 | Gueret et al. | |
| 5,107,871 A | * | 4/1992 | Butcher et al. | 132/304 |
| 5,682,910 A | * | 11/1997 | Kizawa et al. | 132/293 |
| 5,735,297 A | * | 4/1998 | Litton | 132/294 |
| 5,740,938 A | * | 4/1998 | Hofmann et al. | 220/324 |
| 5,842,486 A | * | 12/1998 | Davis et al. | 132/295 |
| 5,908,037 A | * | 6/1999 | Pierson | 132/293 |
| 6,021,901 A | * | 2/2000 | Wolfe | 206/531 |
| 6,055,992 A | | 5/2000 | Skarne et al. | |

(Continued)

FOREIGN PATENT DOCUMENTS

FR 2851895 9/2004

*Primary Examiner*—Ehud Gartenberg
*Assistant Examiner*—Jose S Stephens, III
(74) *Attorney, Agent, or Firm*—Dennison, Schultz & MacDonald

(57) ABSTRACT

Compact (1) for packaging cosmetic products for face care, the said compact comprising a cover (10) usually provided with an inner mirror (60) and a base (20) typically provided with an intermediate support for at least one cup that will contain a cosmetic product (70), the said base and the said cover each having a sidewall (11 and 21). The gripping area comprises two areas (22 and 23) located on the sidewall on each side of the plane of symmetry of the compact and having a height greater than the height of the remainder of the sidewall. Preferably, the sidewall (21) of the base (20) is made of elastomer, at least in the gripping area (22 and 23). The compact may comprise a side closer placed in the gripping area, under an elastomer layer. In another embodiment, the base comprises a flat base (25), a lip (50) acting as a sidewall (21) and a pusher (40) in the shape of an arc or U, trapped between the lip and the base.

8 Claims, 6 Drawing Sheets

U.S. PATENT DOCUMENTS 6,199,559 B1 * 3/2001 Nikolaus et al. ..... 132/294
6,240,930 B1 * 6/2001 Yuhara ..... 132/293
6,354,308 B1 * 3/2002 Kuk ..... 132/301
6,832,686 B2 * 12/2004 Donegan ..... 206/531
2003/0183240 A1 10/2003 Manougian et al.
2004/0031723 A1 * 2/2004 Jean-Louis ..... 206/581
2004/0173498 A1 * 9/2004 Lee ..... 206/581

* cited by examiner

PACKAGING FOR COSMETIC PRODUCTS, TYPICALLY A COMPACT, WITH AN IMPROVED GRIP AND THAT CAN BE OPENED WITH A SINGLE HAND

FIELD OF THE INVENTION

The invention relates to the domain of packaging for cosmetic products and more particularly compacts containing a product for face care, typically in the form of a gel, a pressed or loose powder, foam or cream.

DESCRIPTION OF RELATED ART

Compacts concerned by the invention are packages of cosmetic products that are usually flat, their function being to present a large surface area of the product to the user to facilitate picking up the product using a finger or an applicator under any circumstances. This approximately plane surface is subsequently called the dispensing surface.

In general, compacts typically comprise a hollow cover that is usually provided with an inner mirror and a hollow base, typically provided with an intermediate support (also called internal frame) of one or several cups (also called make-up pans) designed to contain the said cosmetic product. The cover and the base are said to be "recessed" in the sense that they have sidewalls approximately perpendicular to the dispensing surface and that are in continuation with each other when the cover and the base are in the closed position, such that when closed, the compact is approximately in the shape of a flat cylinder or prism.

In general, the cover pivots about a hinge located on the periphery of the base and the cover and that forms the connecting device between the said cover and the said base. This hinge enables articulation of the cover and opening of the compact. The cover and the base are provided with additional means of locking the cover to the base and unlocking it, so as to open and close the said compact. For example, these means may be closer elements, typically a push button. This closer, usually located on the side opposite to the hinge of the compact, is usually formed by cooperation between a closer element of the cover with a closer element of the base or of the internal frame fixed to the base, so as to guarantee that the compact will remain closed at all times except when the user deliberately opens it.

A very large number of embodiments of compacts are known, that may apply to one or several constituents of the compact, and particularly the closer or opening of the compact. Thus, for example concerning patents in the name of the applicant:

patent FR 2 661 080 that describes a makeup compact with a small sized closer, patent FR 2 725 958 that relates to a compact with an edge to edge closer with assisted opening, patent FR 2 737 192 that describes a compact with a pivoting cover provided with a hinge with flexible tabs, patent FR 2 755 352 that describes a compact with assisted opening, patent FR 2 755 353 that describes a compact with an unlocking and pre-opening pusher, patent FR 2 794 723 that describes a compact with improved pre-opening, and patent FR 2 844 434 that describes a compact with a side closer.

Compacts are generally flat, regardless of whether they have a simple or assisted opening, and are held more or less comfortably in a single hand which is consequently more or less well adapted to the usage conditions required for this type of packaging, in other words at any time of the day and at any location. Regardless of the location and the time of the day chosen by the user, it is essential to have a stable compact base that can be held firmly but not too tightly with a single hand, the other hand performing other manipulation functions; opening the cover, placement and orientation of the mirror, picking up and depositing the product on the skin with or without the help of an applicator.

The purpose of the invention is to provide a compact arrangement that guarantees a high operating security and good stability, while keeping production costs reasonable.

Furthermore, when compacts according to the state of the art include assisted opening means—these means typically enable rotation by a certain angle or automatic flipping of the cover once the opening pressure is applied on the push button—the manual opening gesture and/or the manual gripping gesture of the compact possibly hindering assisted or automatic opening of the cover since the fingers are instinctively placed in front and behind the compact to hold it.

Finally, the applicant also searched for a means of providing compacts that are different from compacts according to the state of the art, particularly by their "grip" or their "feel", in other words by the tactile perception of the manual force to be applied to hold them or to open them, quite apart from aesthetic aspect.

SUMMARY OF THE INVENTION

A first object of the present invention is to provide a compact for packaging of cosmetic products for face care, typically in the form of gel, pressed or loose powder, foam or cream, the said compact including a cover usually provided with an inner mirror and a base, typically provided with an intermediate support for at least one cup that will contain a cosmetic product, the said base and the said cover each being provided with a sidewall and being connected to each other through a hinge, wherein the gripping area of the said compact includes two areas which are located on the sidewall of the base, on each side of the median plane (P) of the said hinge, and which are higher than the remainder of the sidewall of the base.

According to the invention, the gripping area of the compact comprises two areas located on the sidewall of the base of the compact, and located on each side of the median plane of the hinge, which is also usually the plane of symmetry of the compact. These gripping areas may be located so as to be perfectly symmetrical, but other more ergonomic locations could also be chosen, adapted to the thumb on one side and to the other fingers on the other side. These areas have a particular size to further improve gripping conditions, and in particular their height is greater than the height of the remainder of the sidewall of the base.

Preferably, the wall of the first area, on which the base and the inside of the thumb will be located, and the wall of the second area, which will be held by other fingers (typically the ring finger and the middle finger), are made of an elastomeric material.

Plastic elastomeric materials are known to be macromolecular materials that return quickly and approximately to their initial shape and dimensions after having given up the application of a stress, said stress being capable of producing a large deformation even if low. They are also known for their tribological properties that, even with a smooth surface, enable a firm grip without it being necessary to apply excessive force, and do not injure the skin of the fingers or the hand. They also produce an impression of softness and warmth to the touch.

Possible elastomeric materials include particularly butadiene-nitrile acrylic copolymers, polychloroprenes, isobutylene-isoprene copolymers, organic polysulphides and isobutylene polymers or isobutenic elastomers. But thermoplastic elastomeric polymers such as styrene-butadiene-styrene (SBS) copolymer, or a styrene-ethylene-butadiene-styrene (SEBS) copolymer or a mix of PP (polypropylene)—EPDM (ethylene propylene diene monomer) that can be advantageously moulded and/or extruded, will preferably be chosen.

In one preferred embodiment of the invention, the open end of the sidewall is in the form of a saddle, the tops of the saddle being located at the side of the gripping areas and the lower parts being located at the hinge and the area diametrically opposite the hinge possibly being provided with a closer. Preferably, the end of the sidewall of the cover also matches a perfectly complementary saddle shape so that there is perfect continuity when the compact is closed. In this way, firstly the compact remains a hermetic receptacle for the cosmetic product and secondly the cover may be opened without the fingers holding it back.

The elastomeric material making the gripping area of the sidewall of the base is particularly useful for compacts with pivoting covers because it considerably improves gripping of the compact using a single hand while it is being opened and thus limits the risks of its contents spilling or flying away regardless of the conditions under which the said compact is used.

Advantage can be taken of the high elasticity of the elastomeric material to provide the sidewall of the base with a closer at the gripping area and to cover this closer with a thin layer of elastomer. When in the lateral position, as in patent applications GB 2 088 335 and FR 2 844 434, the closer is thus prevented from any contact with other products, for example the cosmetic product contained in the compact and can be opened a large number of times without the mechanism being affected by the presence of foreign bodies.

The flexibility of the elastomeric material also makes it possible to envisage a new design of assisted opening means. In the preferred embodiment presented in the example given below, the pusher does not have the same spatial configuration and is no longer moved in the locking direction by a separate elastic means, typically a compression spring. The pusher envisaged in this preferred embodiment of the invention is an elastic means, used for opening rather than for closing.

According to this embodiment, the base of the compact includes several distinct parts made of different materials; a flat base, typically made of a rigid non-elastomeric plastic material on which the cup or the cup holder internal frame is fixed, a lip acting as a flexible partially or totally elastomeric sidewall, and a pusher in the shape of an arc of a circle or ellipse or even a U-shape, placed symmetrically about the median plane of the hinge, that is usually the plane of symmetry of the compact. The shape of the pusher is chosen as a function of the general shape of the compact; an arc if the shape is more or less cylindrical (with a circular or elliptical section), or a U-shape if it is more like a square or a rectangle. Therefore, this pusher is setback and matches the general shape of the sidewall of the compact outside the area adjacent to the hinge, such that the branches of the U or the "edges" of the arc have a certain flexibility near the gripping areas. Said pusher is made from a flexible, elastic material that has good resistance to repeated use; it may be a metal or a plastic material, typically a polyoxymethylene (POM). Its ends are fixed with respect to the base, and it is fitted with locking means in its middle part, in other words at the median plane of the hinge, the locking means typically being a snap-on rib that cooperates with a locking means fixed to the cover, typically also a snap-on rib. By slightly increasing the pressure applied by the hand holding the compact (this pressure is applied on the edges of the arc or the arms of the U), the pusher is elastically deformed and this elastic deformation results in a significant displacement of the said locking means that comes out of the housing that traps it, causing opening of the cover by means of a driving element usually associated with the hinge. The pusher returns to its initial position as soon as the manual pressure drops below a certain value, so that when closing, the locking means can be brought facing each other such that they can once again cooperate to achieve the said locking.

In the preferred embodiment described below, the pusher is an elastic part that is located on the rigid base, its ends abutting on protuberances formed on the said base and that is trapped in an annular cavity of the lip that acts as a flexible sidewall when it is fixed on the said base. Thus, the lip outside the hinge area generally has a toric shape with a U section, the toric cavity that will contain the pusher being delimited by a top wall in the shape of a saddle, the flexible sidewall and an inner skirt. It is substantially irreversibly fixed onto the base by anchor means, typically a set of ribs associated with the inner skirt of the lip that are snapped on the cavities formed on a rigid inner skirt fixed to the base. This rigid inner skirt also cooperates with the outer rim of the base to guide and hold the pusher in position as it is brought into place on the base and to trap it inside the lip.

DESCRIPTION OF A PREFERRED EMBODIMENT

Figure 1:
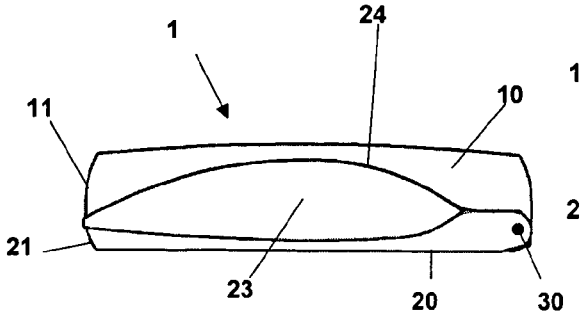
FIG. 1*a* illustrates a right view of a compact according to the invention.
FIG. 1*b* illustrates a front view of the same compact according to the invention.
Figure 1:
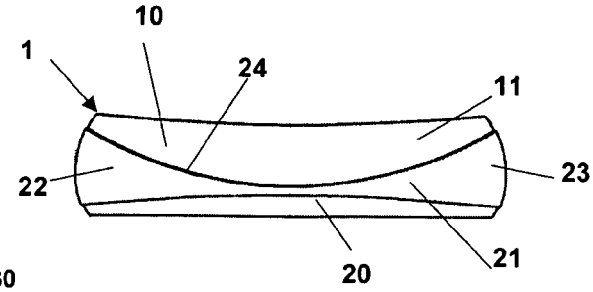
Figure 2:
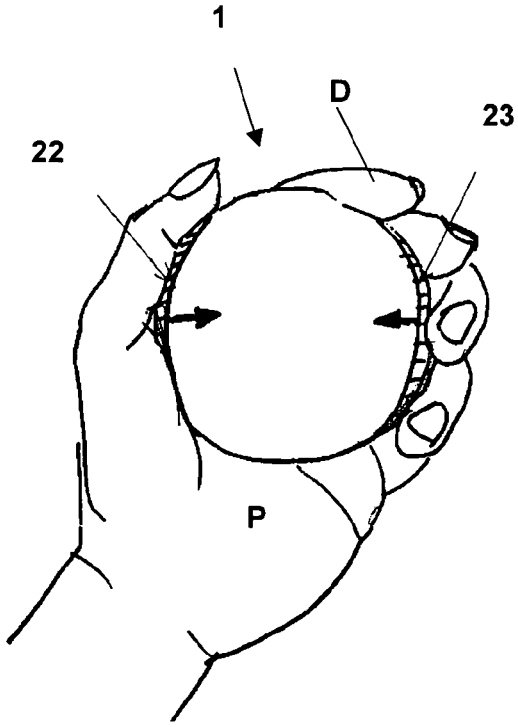
FIG. 2 diagrammatically illustrates gripping of the compact in FIG. 1 in order to use it, before the cover is opened.
Figure 3:
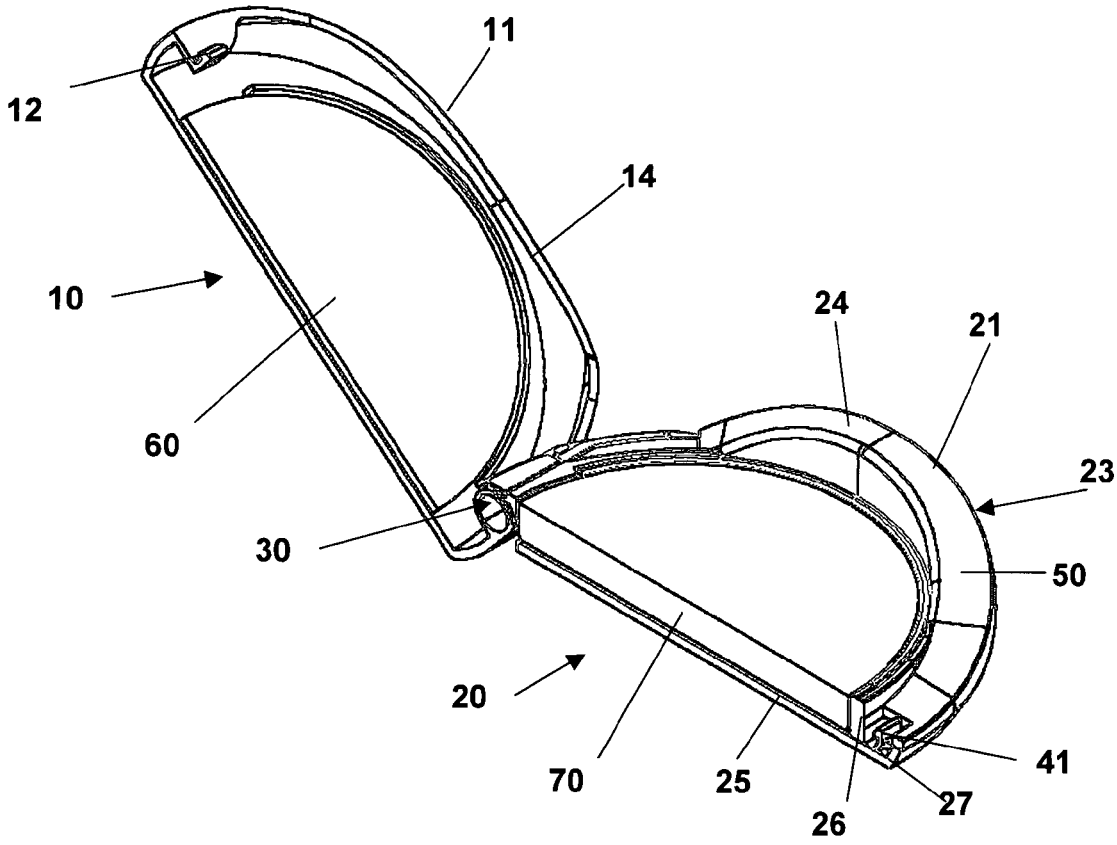
FIG. 3 illustrates an axonometric view of a compact according to the invention, in a section along a diametric plane perpendicular to the hinge, subsequently called the plane of symmetry of the compact.
Figure 4:
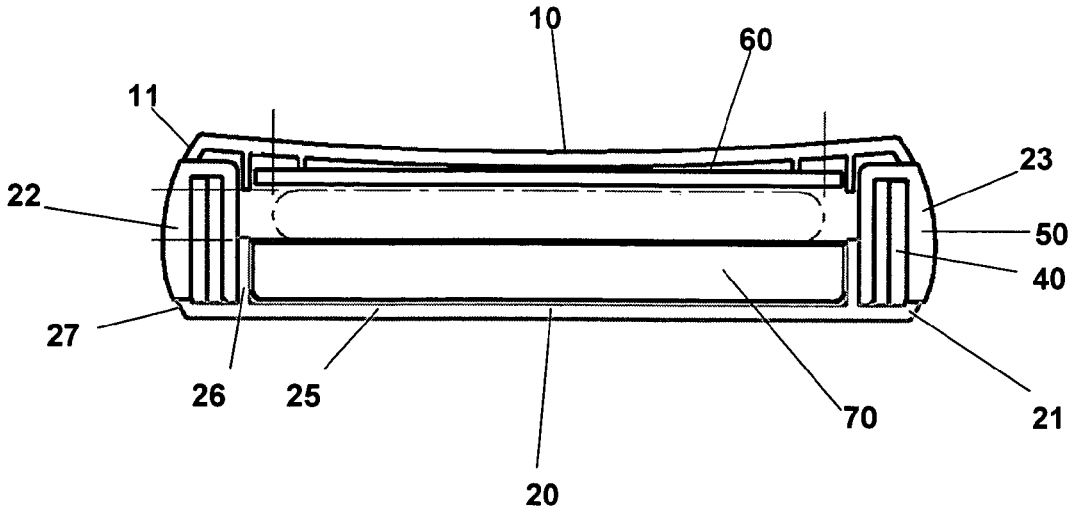
FIG. 4 illustrates a section through the same compact, showing the front view.
Figure 5:
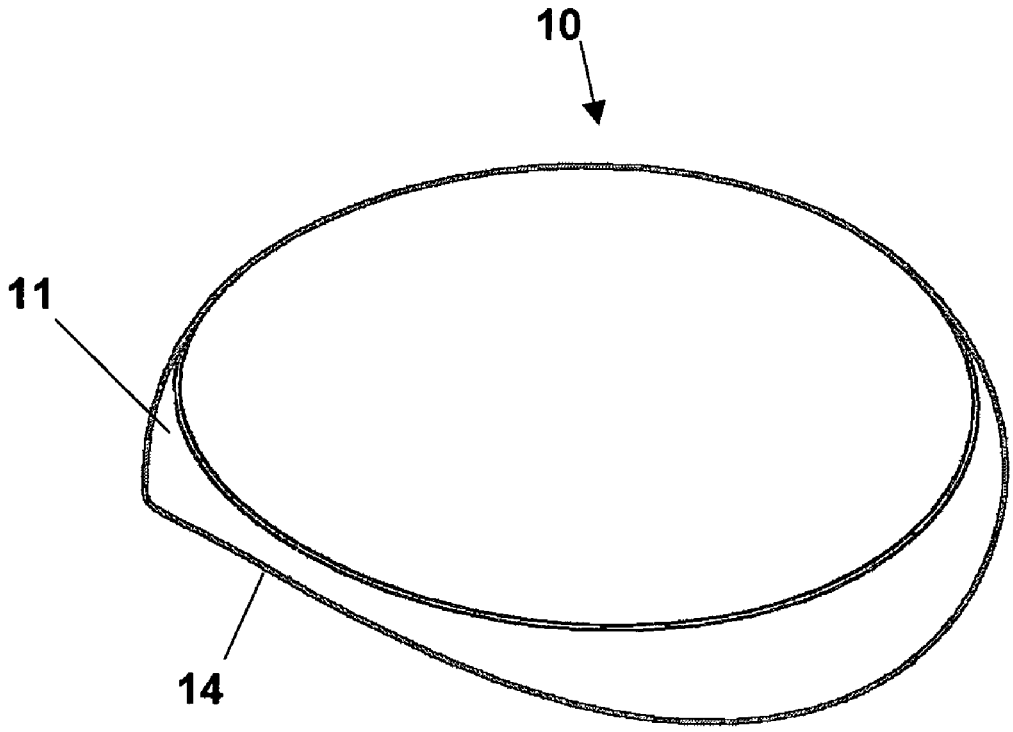
FIG. 5*a* illustrates an axonometric view of the cover of the same compact.
FIG. 5*b* illustrates a section showing the left view (section through the plane of symmetry).
FIG. 5*c* illustrates a front view.
Figure 5B:
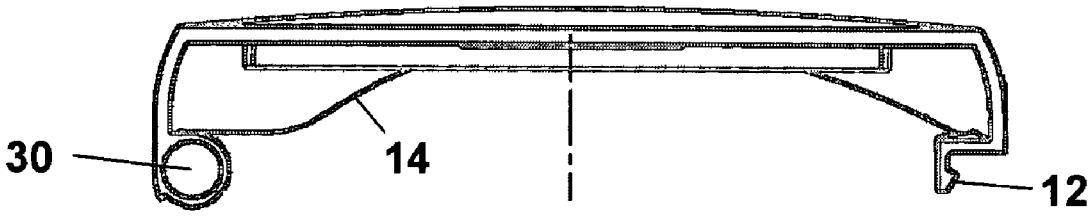
Figure 5C:
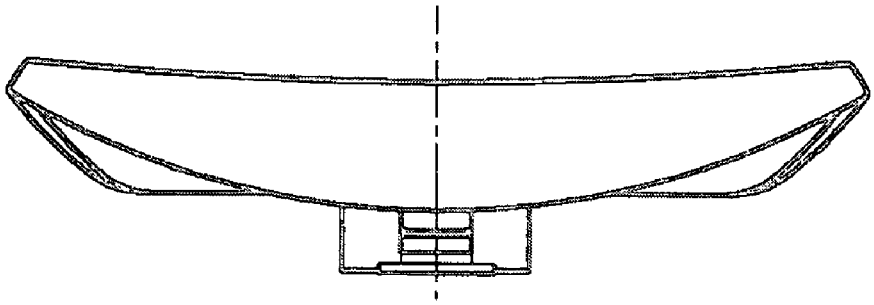
Figure 6A:
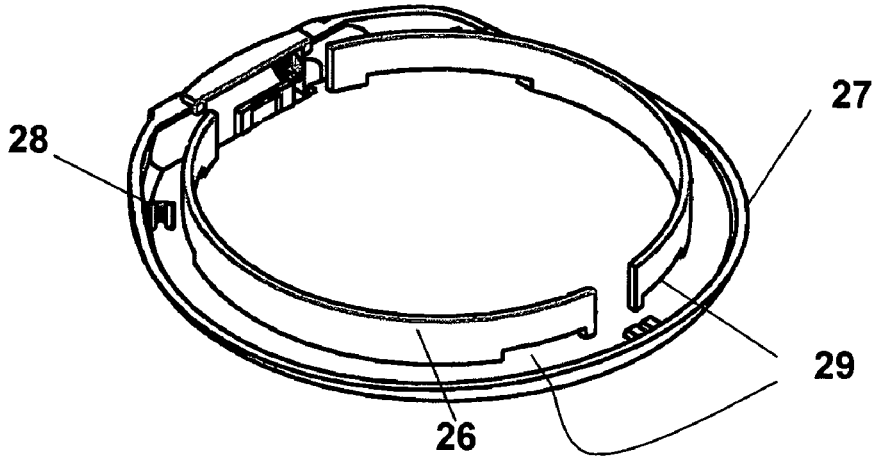
FIG. 6*a* illustrates an axonometric view of the base of the same compact.
Figure 6B:
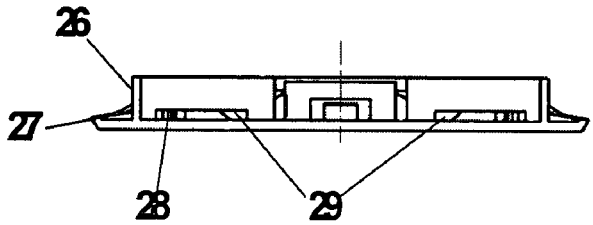
FIG. 6*b* illustrates a section showing the front view (diametric section plane perpendicular to the plane of symmetry).
Figure 6C:
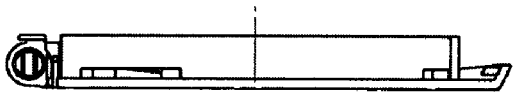
FIG. 6*c* illustrates a section showing the left view (section through the plane of symmetry).
Figure 6D:
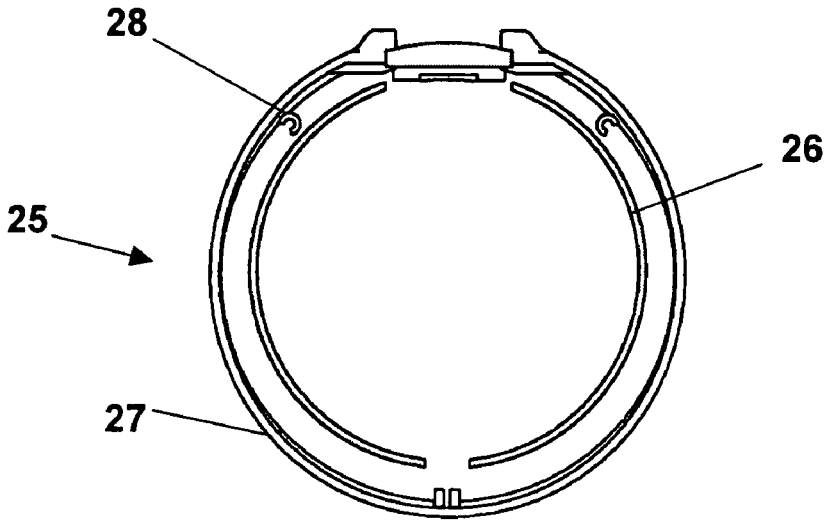
FIG. 6*d* illustrates a top view.
Figure 7A:
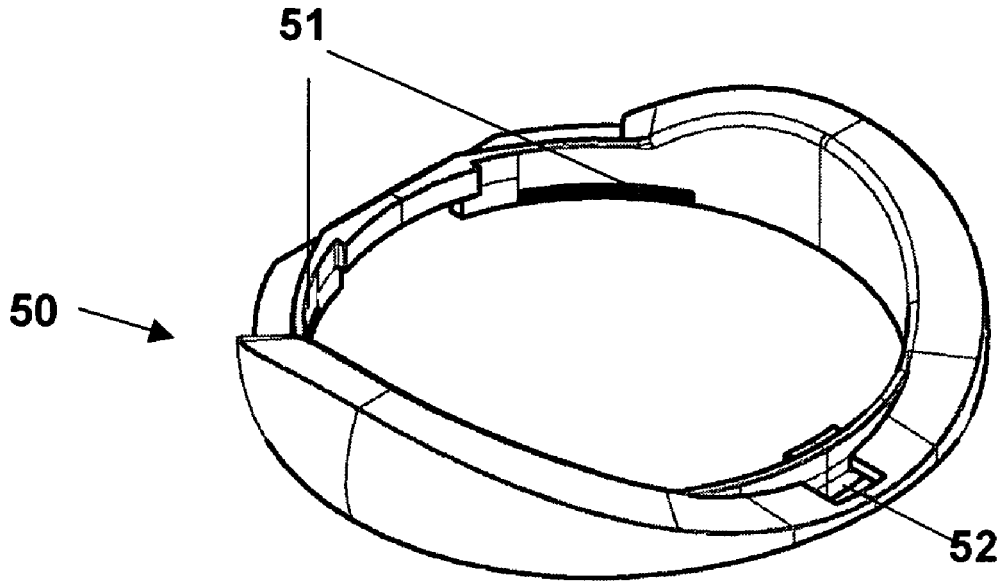
FIG. 7*a* illustrates an axonometric view of the lip acting as a flexible sidewall.
Figure 7B:
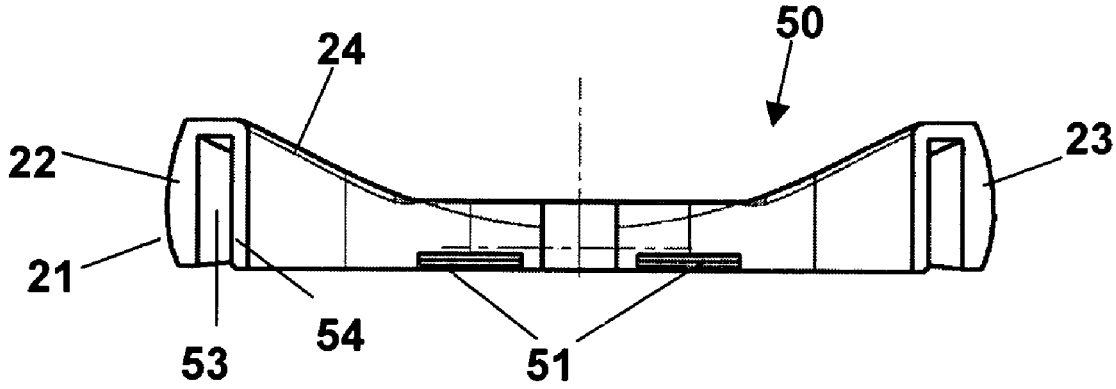
FIG. 7*b* illustrates a section showing the front view (section plane diametrically perpendicular to the plane of symmetry).
Figure 7C:
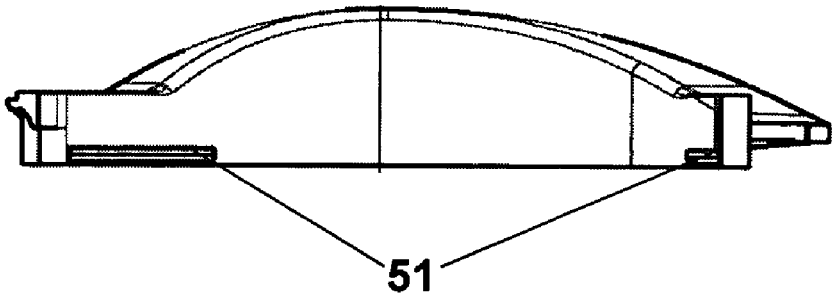
FIG. 7*c* illustrates a section showing the left view (section through the plane of symmetry).
Figure 8A:
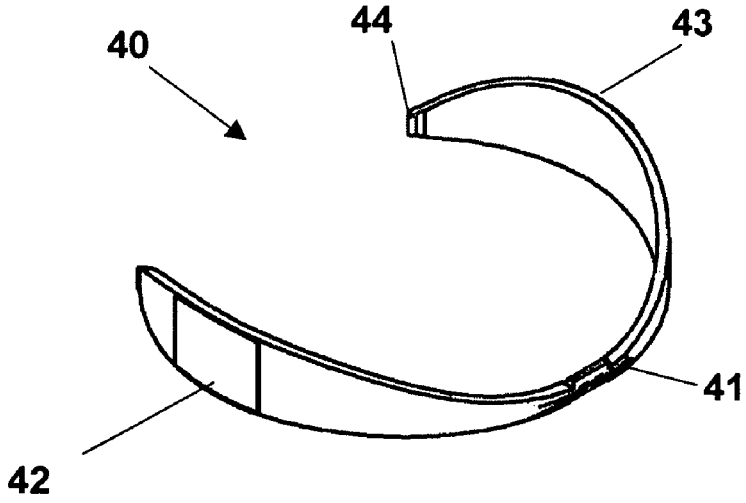
FIG. 8*a* illustrates an axonometric view of the pusher of the same compact.
Figure 8B:
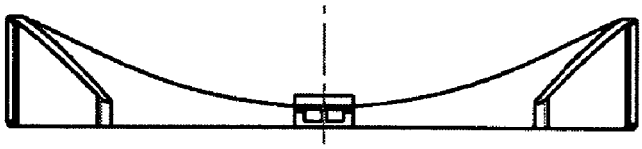
FIG. 8*b* illustrates a back view.
Figure 8C:
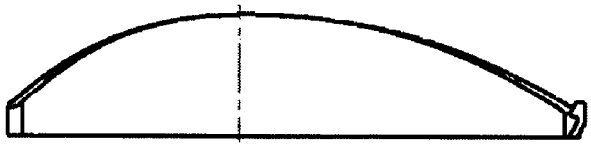
FIG. 8*c* illustrates a section showing the left view (section through the plane of symmetry).
Figure 8D:
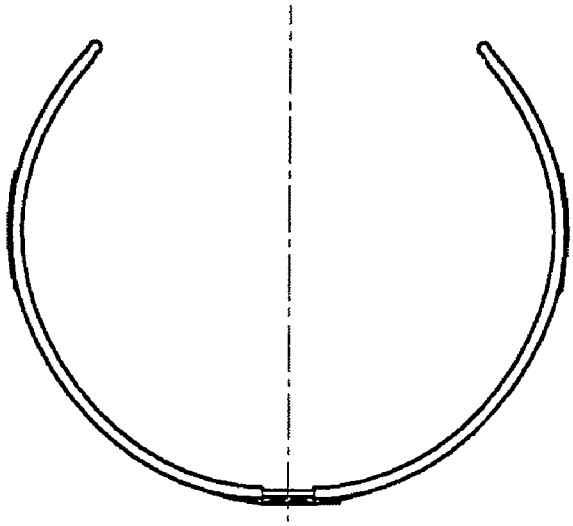
FIG. 8*d* illustrates a top view.

FIGS. 1 to 8

The compact 1 is intended for packaging of a cosmetic product for face care in the form of a pressed powder. The compact 1 comprises a cover 10 provided with an inner mirror 60 and a base 20 with a cup of cosmetic product 70. The base 20 and cover 10 are each provided with a sidewall (21 and 11 respectively). The outer surface of the sidewall 21 of the base 20 is made of a styrene-ethylene-butadiene-styrene copolymer (SEBS), a thermoplastic elastomeric material, particularly in the gripping area of the compact (22 and 23).

The cover 10 made of ABS (acrylobutadiene styrene) pivots about a hinge 30 that forms the connecting device between the cover 10 and the base 20.

The gripping area consists of two areas 22 and 23 located on the sidewall 21 of the base 20 and located on each side of the diametric plane P perpendicular to the hinge, also called the median plane of the hinge 30 and the plane of symmetry of the compact. The wall of the first area 22, in which the base and the inside of the thumb will fit, and the wall of the second area 23 that will be held by the other fingers, are distributed symmetrically about the plane of symmetry P of the compact. These walls are covered with SEBS.

To further improve gripping conditions, the height of these areas is greater than the height of the remainder of the sidewall 21 of the base 20. Consequently, the open end 24 of the sidewall is in the shape of a saddle, the tops of the saddle being located at the side of the gripping areas 22 and 23. The open end 14 of the sidewall 11 of the cover 10 matches a perfectly complementary shape. Thus, the cover can be opened without being held back by the fingers.

The base 20 of the compact includes a flat ABS base 25 on which a cup of cosmetic product 70 is housed, together with a lip 50 made of SEBS that acts like a flexible sidewall 21 and a pusher 40 in the shape of an arc of a circle located symmetrically about the plane of symmetry of the compact, perpendicular to the hinge 30. The edges 42 and 43 of the arc of the pusher 40 have a certain flexibility at the gripping areas 22 and 23. The pusher 40 is made of polyoxymethylene (POM). It comprises a snap-on rib 41 at its mid-point, in other words at the plane of symmetry of the compact, that cooperates with rib 12 of the cover. By applying a slightly greater pressure with the hand that holds the compact (this pressure is applied on edges 42 and 43 of the arc), the pusher 40 is deformed elastically and this elastic deformation results in a significant displacement of rib 41 that comes out of the housing that traps it and opens the cover 10 due to the driving element (not shown) included in the hinge 30. Automatic opening of the cover 10 is achieved by a spring mechanism located in the hinge 30 as described in patent FR 2 844 434. Other mechanisms like those described in EP 1 403 460 may also be used. The pusher 40 returns to its initial position as soon as the hand pressure drops below a certain value, which during closing brings the ribs 41 and 12 to face each other such that they can once again cooperate to achieve the said locking. The stiffness of the pusher is defined such that the critical value of the force at which the rib comes out of its housing is significantly greater than the standard value of an holding force without gripping too tightly, typically of the order of 0.1 Newtons, but while remaining easy to apply by the user typically by applying an opening force of between 5 and 10 Newtons.

The pusher 40 is located on the rigid base 25, its ends 44 abutting on the protuberances 28 formed on said base. It is trapped in an annular cavity 53 of the lip 50 that acts as a flexible sidewall when it is fixed onto the said base. Thus outside the hinge area, the lip 50 has a globally toric shape with a U-section, the toric cavity 53 holding the pusher being delimited by top wall 24 shaped like a saddle, flexible sidewall 21 and inner skirt 54. It is substantially irreversibly fixed on the base by ribs 51 that are snapped on the cavities 29 formed on the rigid inner skirt 26 fixed to the base 25. This rigid inner skirt 26 and the outer edge 27 of the base also guides and holds the pusher 40 in position when it is put into place on the base and traps it on the inside of the lip 50 that acts as a flexible sidewall.

What is claimed is:

1. Compact for packaging of cosmetic products, the compact comprising:

a cover having a sidewall, a base having a sidewall, and provided with an intermediate support for at least one cup containing a cosmetic product, a hinge through which the base and the cover are connected to each other, a median plane of the hinge passing through the compact, and two gripping areas, each of said gripping areas being located on the sidewall of the base with one of said gripping areas on each side of the median plane, the sidewall of the base having a greater height in the gripping areas than the height of the remainder of the sidewall of the base, wherein the sidewall of the base is provided with a locking member that cooperates with a locking member fixed to the cover, the cooperating locking members being arranged in the median plane of the hinge, wherein the compact comprises a mechanism for release of the locking members through pressure on the gripping areas arranged on each side of the median plane, the gripping areas being disposed laterally with respect to, and spaced from the locking member of the base, the pressure on the gripping areas causing release of the locking members in the median plane and opening of the compact, and wherein the base of the compact comprises a flat base, with a lip acting as the sidewall at least partially made of elastomeric material, and a pusher in the shape of one of an arc of a circle, an arc of an ellipse, and a U-shape, located symmetrically about the median plane of the compact, the pusher being set back and generally matching the sidewalls in general shape outside an area adjacent to the hinge, the pusher being supple near the gripping areas, the pusher having ends which are fixed with respect to said base and being fitted with locking means in a middle part thereof that cooperates with a locking means fixed to the cover.

2. Compact according to claim 1, wherein the elastomeric plastic material is a thermoplastic elastomer selected from the group consisting of a styrene-butadiene-styrene (SBS) copolymer, a styrene-ethylene-butadiene-styrene (SEBS) copolymer, and a blend of polypropylene (PP) and ethylene propylene diene monomer (EPDM).

3. Compact according to claim 1, wherein the sidewall of the base has an open end the form of a saddle which is complementary to the shape of the sidewall of the cover at an open end thereof.

4. Compact according to claim 1, wherein the locking member of the base is covered by an elastomeric material in the form of an easily deformable thin film.

5. Compact according to claim 1, wherein the pusher is an elastic part trapped between the base and the lip that acts as a flexible sidewall, the ends abutting on protuberances arranged on the said base.

6. Compact according to claim 5, wherein the pusher is trapped in an annular cavity of the lip when the lip is fixed to the said base.

7. Compact according to claim 6, wherein the lip has a globally toric shape with a U-section outside a hinge area and a toric cavity constructed and arranged to hold the pusher which is delimited by a top wall in the shape of a saddle, a flexible sidewall and an inner skirt, and wherein the lip is substantially irreversibly fixed to the said base using anchor means.

8. Compact according to claim 7, wherein the hinge is provided with an automatic opening mechanism of the cover.

* * * * *